US006871855B1

(12) United States Patent
Ko

(10) Patent No.: US 6,871,855 B1
(45) Date of Patent: Mar. 29, 2005

(54) COMMISSION-FREE PAI GOW

(76) Inventor: Shenli Ko, P.O. Box 82225, Las Vegas, NV (US) 89180

( * ) Notice: Subject to any disclaimer, the term of this patent is extended or adjusted under 35 U.S.C. 154(b) by 361 days.

(21) Appl. No.: 10/046,477

(22) Filed: Oct. 25, 2001

(51) Int. Cl.[7] ..... A63F 1/00

(52) U.S. Cl. ..... 273/292; 273/292; 273/274; 463/13

(58) Field of Search ..... 273/292, 274, 273/309; 463/12, 13

(56) References Cited

U.S. PATENT DOCUMENTS

| | | | | | |
|---|---|---|---|---|---|
| 4,659,087 | A | * | 4/1987 | Shen et al. | 273/274 |
| 5,678,821 | A | * | 10/1997 | Hedman | 273/292 |
| 5,741,012 | A | * | 4/1998 | So et al. | 273/292 |
| 5,788,241 | A | * | 8/1998 | Ung | 273/292 |
| 5,863,042 | A | * | 1/1999 | Lo | 273/292 |
| 5,931,472 | A | * | 8/1999 | Ko | 273/292 |
| 6,070,876 | A | * | 6/2000 | Ko | 273/293 |
| 6,135,453 | A | * | 10/2000 | Srichayaporn | 273/292 |

OTHER PUBLICATIONS

"9's Up", Harrah's Lake Tahoe Resorts, 1988.*

* cited by examiner

*Primary Examiner*—Benjamin Layno
(74) *Attorney, Agent, or Firm*—Robert Ryan Morishita; Anderson & Morishita, LLC

(57) ABSTRACT

Four tiles are dealt to players and a banker who arrange the tiles into a two-tile high hand and a two-tile low hand. Wagers are resolved by comparing the banker high hand and low hand to each player high hand and low hand, respectively. A first subset of banker hands is defined and player winning outcomes are rewarded at a modified rate if the banker's hand is within the first subset. Otherwise, player winning outcomes are rewarded at even money without retaining a commission. Optionally, a second subset of player hands that results in a banker winning outcome is defined such that the player's wager is collected if the player's hand is within the second subset regardless of the comparison to the banker high and low hands. Optionally, a third subset of player hands that results in a player winning outcome is defined such that players are rewarded at greater than or equal to even money if the player's hand is within the third subset regardless of the comparison to the banker high and low hands. In a further optional embodiment, the player may be rewarded at greater than or equal to even money if the player's hand is within the third subset and the player's high and low hands outrank the banker's high and low hands.

26 Claims, 4 Drawing Sheets

COMMISSION-FREE PAI GOW

FIELD OF THE INVENTION

The present invention relates to gambling games. More specifically, the present invention is an improved commission-free Pai Gow game.

BACKGROUND OF THE INVENTION

Pai Gow is a well known gambling game originating in China. Pai Gow is played with a set of thirty-two tiles, each of which includes a number of pips indicating the rank of the tile. For reasons of tradition, the rank of the tile is not directly related to the number of pips on the tile, that is, more pips does not necessarily translate to a higher rank. For example, a tile with twelve pips is the highest ranking tile; a tile with three pips is the lowest ranking tile. Similarly, the rank of a combination of tiles is not directly related to the sum of the pips on the tile. For example, one high ranking pair, the Gee Joon, or Supreme Pair, comprises a tile with six pips and a tile with three pips.

A game of Pai Gow begins with the players making a wager. The game of Pai Gow may be house banked or a player may choose to act as the banker. A dealer separates the thirty two tiles into eight piles of four tiles each. Three dice are rolled to determine the distribution of the tile hands. The tile hands are distributed to the players and the dealer. Each player organizes his or her tiles into a two-tile high hand and a two-tile low hand. The low hand must not have a higher ranking than the high hand according to the conventional ranking of Pai Gow tiles. If the tiles are incorrectly arranged, the player automatically loses The player positions his or her tiles on the playing surface with the two-tile low hand in front of the two-tile high hand.

The dealer reveals his or her tiles and likewise organizes the four tiles into a two-tile high hand and a two-tile low hand Wagers are resolved by comparing the rank of the player's high hand and low hand to the dealer's high hand and low hand, respectively. If the player's high and low hands outrank the dealer's high and low hands, respectively, the player wins and is paid even money, less a five percent (5%) commission to the casino. If the dealer's high and low hands outrank or tie the player's high and low hands, respectively, the dealer collects the player's wager. If one, but not both, of the player's hands outrank the one of the dealer's hands, the game is a push and the wager is neither, collected nor paid.

One drawback of Pai Gow is the commission charged on winning wagers. To maintain a house advantage sufficient to make Pai Gow tables profitable, it has been found that a five percent commission is necessary. However, the commission charged must be tracked by the dealer and each player must periodically settle his commission owed during play. The time required to track and settle commissions often result in a loss of revenue because fewer hands can be dealt per unit of time. Additionally, the conventional five percent commission often results in a fractional amount that is often lost because of the denominations used at gaming tables. For example, on a twenty-five dollar wager, the house usually collects a one dollar commission rather than the one dollar and twenty-five cents owed to avoid the cumbersome tracking of small denomination coins. As can be seen, this results in a loss of twenty percent of the commission owed to the house.

In the game of Pai Gow Poker, one game intended to address the problem of house commissions is the so-called "no push" Pai Gow Poker. In conventional Pai Gow Poker, seven cards are dealt to the banker and the players. The banker and players arrange the cards into a five-card high hand and a two-card low hand. Each player compares his or her high hand to the banker's high hand and his or her low hand to the banker's low hand. The player wins if both hands outrank the corresponding banker's hands according to conventional poker rankings. If one of the player's hands outranks one of the banker's hands, and the other banker's hand ties or outranks the other player hand, the player and banker "push" and the player neither wins nor loses his wager. If both the banker's hands outrank or tie the player's hands, the player loses his or her wager in the "no push" version of Pai Gow Poker, the commission can be eliminated because, unlike conventional Pai Gow Poker, a tie-breaker is instituted to eliminate all pushes. The, is, if a push exists, the push is resolved using a card or die to determine whether the player or dealer wins the player's wager.

The drawback to this game is that many players prefer the availability of the push outcome because a push results in no loss and extends the player's playing time and bankroll. In other words, players dislike the tie-breaker instituted in the "no push" version of Pai Gow Poker because players could still lose their wager even if there is a push. This is significant because the player's hand and the dealer's hand will push approximately 40% of the time in the game of Pai Gow Poker. The probability that the player and dealer cards will tie is 5.9506%. Thus, the player of "no push" Pai Gow Poker can expect to lose an additional 2.38% of the time due to the tiebreaker (40% * 5.9506%=2.38%). This is in addition to the inherent ~1% house advantage resulting from the house winning all identical hands.

Thus, it can be seen that there is a need in the art for a Pai Gow method that eliminates the commission on winning wagers.

SUMMARY OF THE INVENTION

The method of the present invention is an improvement on conventional Pai Gow. The improvement permits the elimination of retained commissions that is integral with conventional Pai Gow. As known in the prior art, Pai Gow is played between a barker and at least one player using a set of thirty-two tiles. The Pai Gow game begins with players making a wager. The players and banker each receive four tiles and arrange the tiles into a two-tile high hand and a two-tile low hand. The banker resolves wagers by comparing the banker high hand and low hand to each player high hand and low hand, respectively. A banker winning outcome occurs if the player's high and low hands do not outrank the banker's high and low hands, respectively. Conversely, a player winning outcome occurs if the player's high and low hands both outrank the banker's high and low hands, respectively. Finally, a push outcome occurs if one player hand does not outrank the corresponding banker hand and the remaining player hand outranks the corresponding banker hand.

According to the improved method of the present invention, a first subset of banker high and low hands is defined. The first subset may include any set of high and low hands. However, in an optional embodiment, the first subset may only include one or more banker low hands. For, example, in one optional embodiment, a hand ranking chart may be constructed to determine a mathematical ranking of possible hands and the first subset may include the set of banker low hands having a specific ranking.

During the step of resolving the wagers, the banker's hands are compared to the first subset. If, upon comparison of the player high and low hands to the banker high and low hands, respectively, a player winning outcome is obtained and the banker high and low hands are within the first subset of banker hands, the player is rewarded at a modified rate greater than or equal to zero and less than even money. In other words, player winning outcomes are paid at a reduced modified rate, rather than at even money, if the banker holding is within the first subset.

If the banker's hands are not within the first subset, wagers are paid with no retained commission on player winning outcomes, wagers are collected from players on banker winning outcomes, and wagers are neither paid nor collected from players on push outcomes. Thus, because player winning outcomes are rewarded at the modified rate in the circumstance where the banker's hand is within the first subset, player winning outcomes where the banker's hand is not within the first subset may be rewarded at even money with no retained commission. The present invention contemplates a number of possible modified rates and first subsets that may be selected to replace the house advantage of the commission.

For example, the first subset may contain any high hand combined with a low hand ranking lower than eight on the following hand ranking table.

TABLE 1

| Tile | 12 | 2 | H8 | H4 | H10 | H6 | L4 | 11 | L10 | H7 | L6 | 9 | L8 | L7 | 5 | Gee |
|---|---|---|---|---|---|---|---|---|---|---|---|---|---|---|---|---|
| 12 | 101 | 35 | 84 | 54 | 15 | 72 | 54 | 25 | 15 | 82 | 72 | 86 | 84 | 82 | 64 | 72 |
| 2 | 35 | 100 | 83 | 53 | 14 | 71 | 53 | 24 | 14 | 81 | 71 | 85 | 83 | 81 | 63 | 71 |
| H8 | 84 | 83 | 99 | 13 | 70 | 34 | 13 | 80 | 70 | 45 | 34 | 62 | 52 | 45 | 23 | 34 |
| H4 | 54 | 53 | 13 | 98 | 33 | 1 | 69 | 44 | 33 | 7 | 1 | 22 | 12 | 7 | 79 | 61 |
| H10 | 15 | 14 | 70 | 33 | 97 | 51 | 32 | 6 | 1 | 60 | 51 | 78 | 68 | 60 | 43 | 51 |
| H6 | 72 | 71 | 34 | 1 | 51 | 96 | 1 | 59 | 50 | 21 | 11 | 42 | 31 | 21 | 5 | 77 |
| L4 | 54 | 53 | 13 | 69 | 32 | 1 | 95 | 41 | 30 | 4 | 1 | 20 | 10 | 4 | 76 | 58 |
| 11 | 25 | 24 | 80 | 44 | 6 | 59 | 41 | 94 | 3 | 67 | 57 | 1 | 75 | 67 | 49 | 57 |
| L10 | 15 | 14 | 70 | 33 | 1 | 50 | 30 | 3 | 93 | 56 | 48 | 74 | 66 | 56 | 40 | 48 |
| H7 | 82 | 81 | 45 | 7 | 60 | 21 | 4 | 67 | 56 | 92 | 19 | 47 | 39 | 29 | 9 | 19 |
| L6 | 72 | 71 | 34 | 1 | 51 | 11 | 1 | 57 | 48 | 19 | 91 | 38 | 28 | 18 | 2 | 73 |
| 9 | 86 | 85 | 62 | 22 | 78 | 42 | 20 | 1 | 74 | 47 | 38 | 90 | 55 | 46 | 27 | 37 |
| L8 | 84 | 83 | 52 | 12 | 68 | 31 | 10 | 75 | 66 | 39 | 28 | 55 | 89 | 36 | 17 | 26 |
| L7 | 82 | 81 | 45 | 7 | 60 | 21 | 4 | 67 | 56 | 29 | 18 | 46 | 36 | 88 | 8 | 16 |
| 5 | 64 | 63 | 23 | 79 | 43 | 5 | 76 | 49 | 40 | 9 | 2 | 27 | 17 | 8 | 87 | 65 |
| Gee | 72 | 71 | 34 | 61 | 51 | 77 | 58 | 57 | 48 | 19 | 73 | 37 | 26 | 16 | 65 | 102 |

In Table 1, H8 represents High Eight, H4 represents High Four, H10 represents High Ten, H6 represents High Six, L4 represents Low Four, L10 represents Low Ten, H7 represents High Seven, L6 represents Low Six, L8 represents Low Eight, L7 represents Low Seven, and Gee represents either of the Wild Three or Wild Six known in conventional Pai Gow tiles. If a player winning outcome is obtained and the banker low hand has a ranking of less than eight, the player is paid at a modified rate of zero, that is, the player is not paid but his or her wager is returned like in a push.

Similarly, in an alternate optional embodiment, the first subset comprises any high hand combined with a low hand lower than sixteen according to the same Table 1. In such an optional embodiment, the modified rate is 1:2. That is, rather than paying a player at even money, the player is paid at the reduced modified rate of 1:2 for obtaining a player winning outcome when the banker holding is within the first subset.

In another optional embodiment, the method may include defining a second subset of player hands that automatically results in a banker winning outcome. If the player's high and low hands are within the second subset, the player loses his or her wager without regard to the result of the comparison to the banker high and low hands. For example, in one optional embodiment, the second subset comprises any high hand combined with a low hand less than eight according to Table 1. As with the optional embodiment above, player winning outcomes are paid at even money without retained commission.

In this embodiment, a further feature of an insurance wager may be provided. The insurance wager would pay, optionally at even money, if the player receives a hand in the second subset. However, the player would lose his insurance wager if any other hand is dealt.

In a further embodiment of the present method, a third subset of player hands that automatically results in a player winning outcome is defined. If the player's high and low hands are within the third subset the player is rewarded at greater than or equal to even money without regard to the result of the comparison to the banker high and low hands. For example, in one optional embodiment, the third subset comprises any high hand combined with a low hand greater than Gong. In such an optional embodiment, the player may be rewarded at 3:2 regardless of the comparison to the banker hands.

In a further optional, embodiment, if a player's high and low hands are within the third subset and the player's high and low hands outrank the banker's high and low hands, the player may be rewarded at greater than or equal to even money.

It is an object of the present invention to provide an improved method for Pai Gow that eliminates commissions from winning player wagers.

DESCRIPTION

Figure 1:
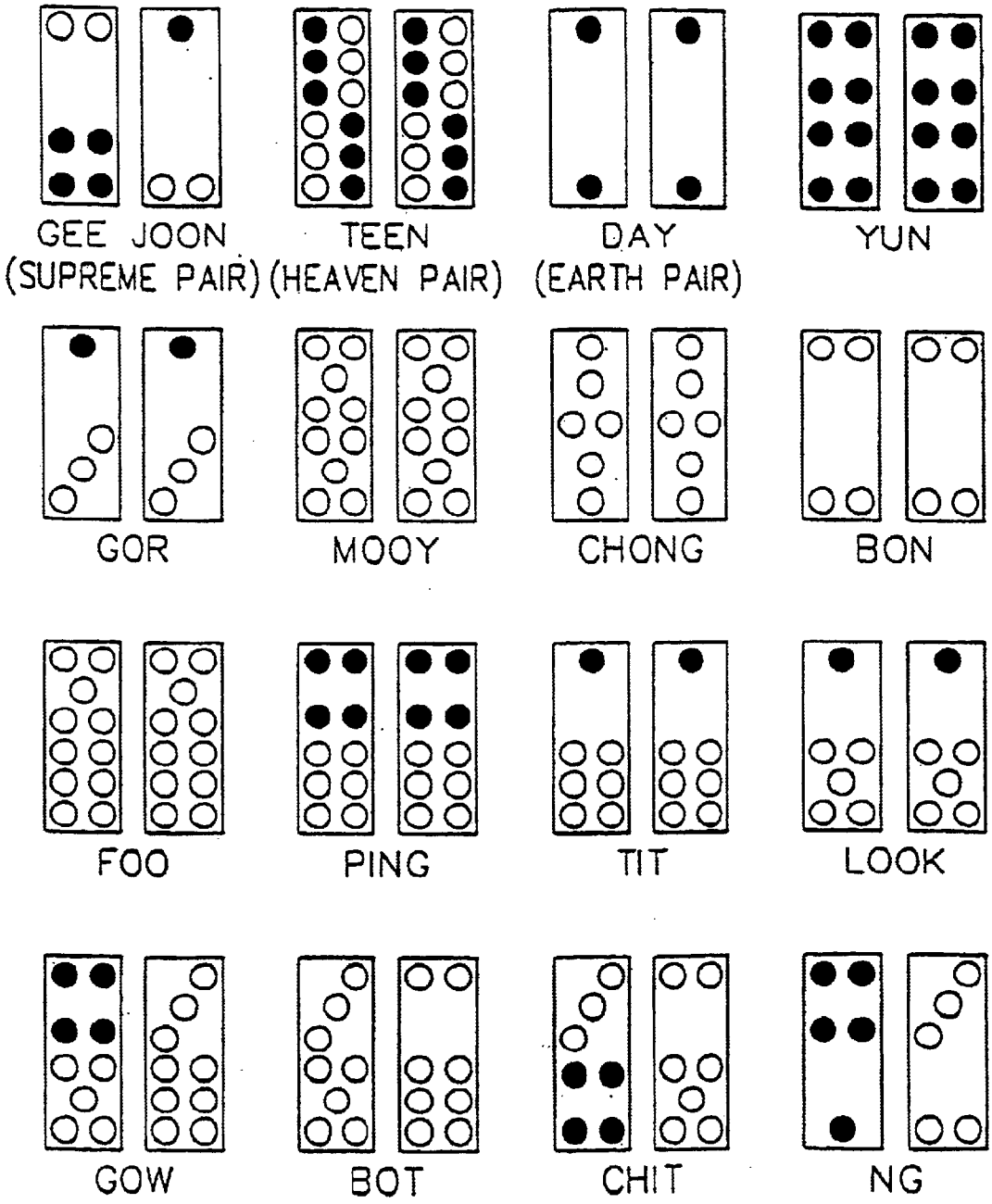
FIG. 1 shows the thirty-two Pai Gow playing tiles arranged in certain highly ranked pairs in the order of ranking according to the conventional rules of Pai Gow.
Figure 2:
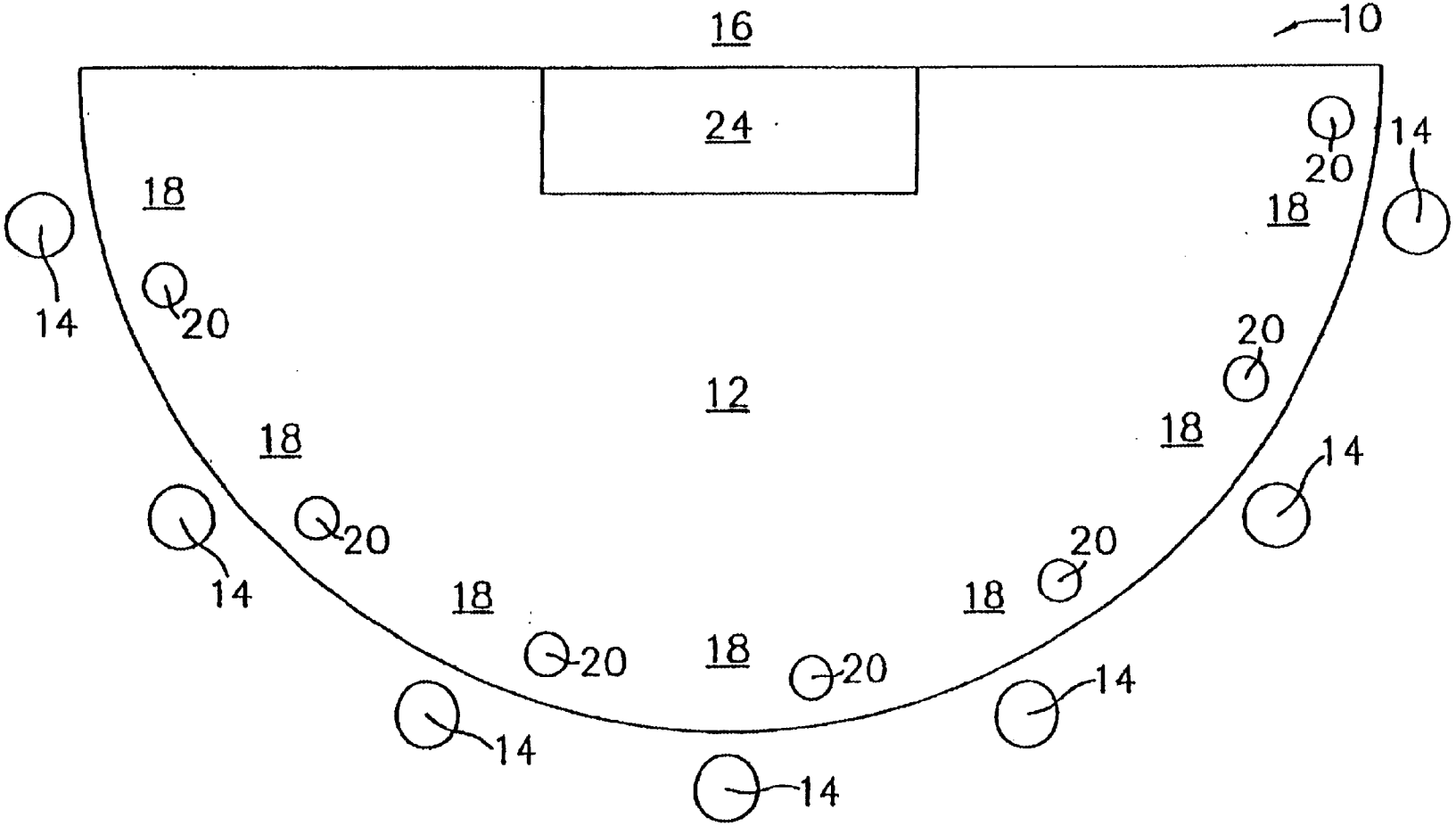
FIG. 2 is a top view of a table layout for the play of the Pai Gow game according to an embodiment of the present invention.

Reference is now made to the figures wherein like parts are referred to by like numerals throughout. Referring to the figures, the present game is played using Pai Gow tiles, shown in FIG. 1, on a layout 10 covering a playing surface 12 such as a gaming table, shown in FIG. 2. Referring to FIG. 1, the improved method of the present invention utilizes Pai Gow tiles ranked in a conventional fashion known in the art. Optionally, a set of thirty-two Pai Gow tiles is used. With reference to FIG. 2, the layout 10 includes a plurality of player positions 14 and a dealer position 16. Each player position 14 includes a betting area 20 and an action area 18. A check tray 24 holding gaming checks (i.e. chips) is located at the dealer position 16.

The game of Pai Gow is generally played as a live game. It is contemplated, however, that the improved Pai Gow of the present invention could be played as a live game or as a computer or video game. Also, Pai Gow may be played as a house banked game or may include a rotating banker. That is, Pai Gow may be played where either the game operator, e.g. a casino, or a player collects losing wagers and pays winning wagers. Either embodiment is possible in the improved version described hereafter. Accordingly, the word "dealer" is used to refer only to the person mixing and dealing the tiles, typically an employee of the game operator, whereas the word "banker" is used to refer to the entity banking the game.

Figure 3:
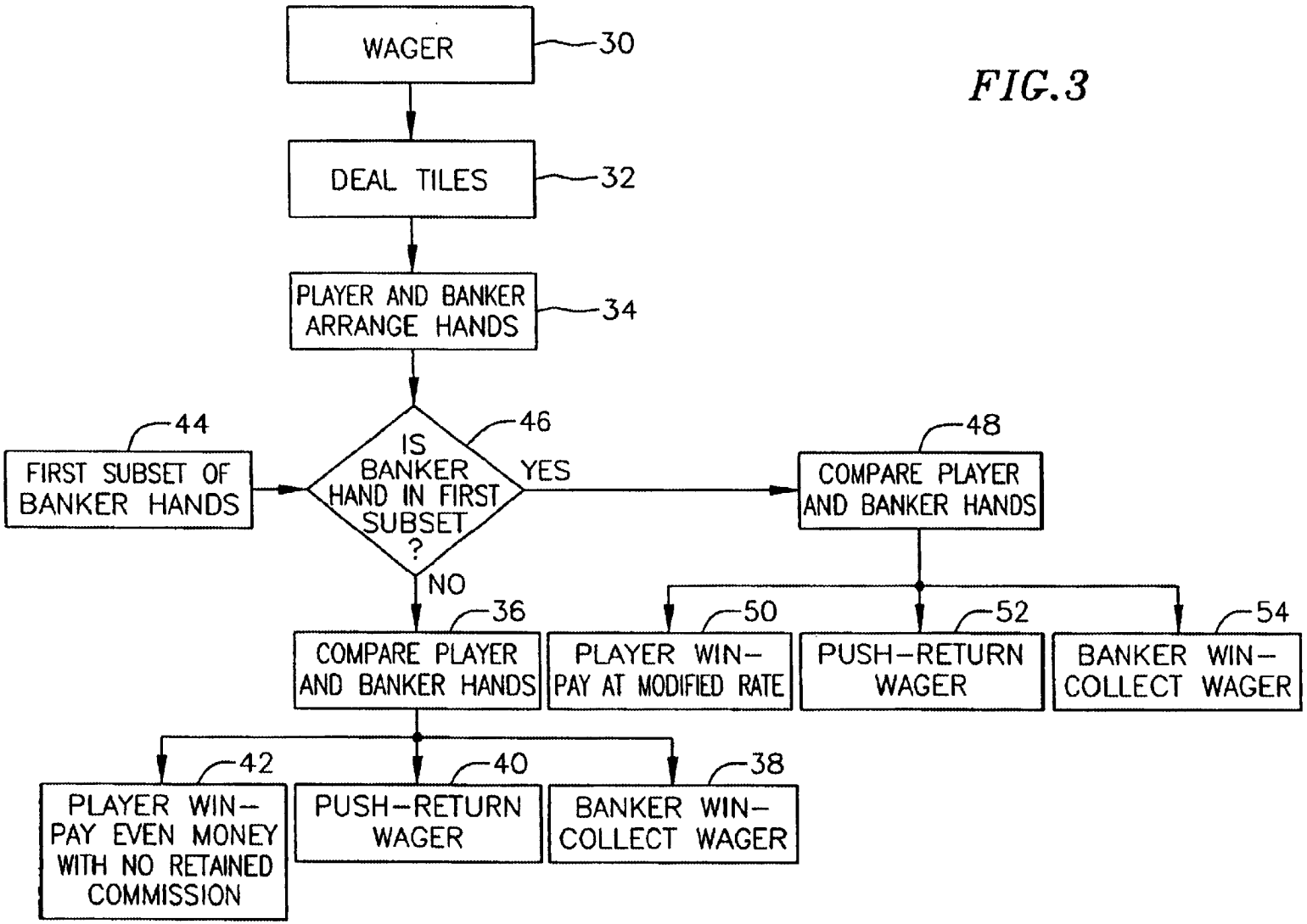
FIG. 3 is a flowchart of a Pai Gow game according to an embodiment of the present invention.
Figure 4:
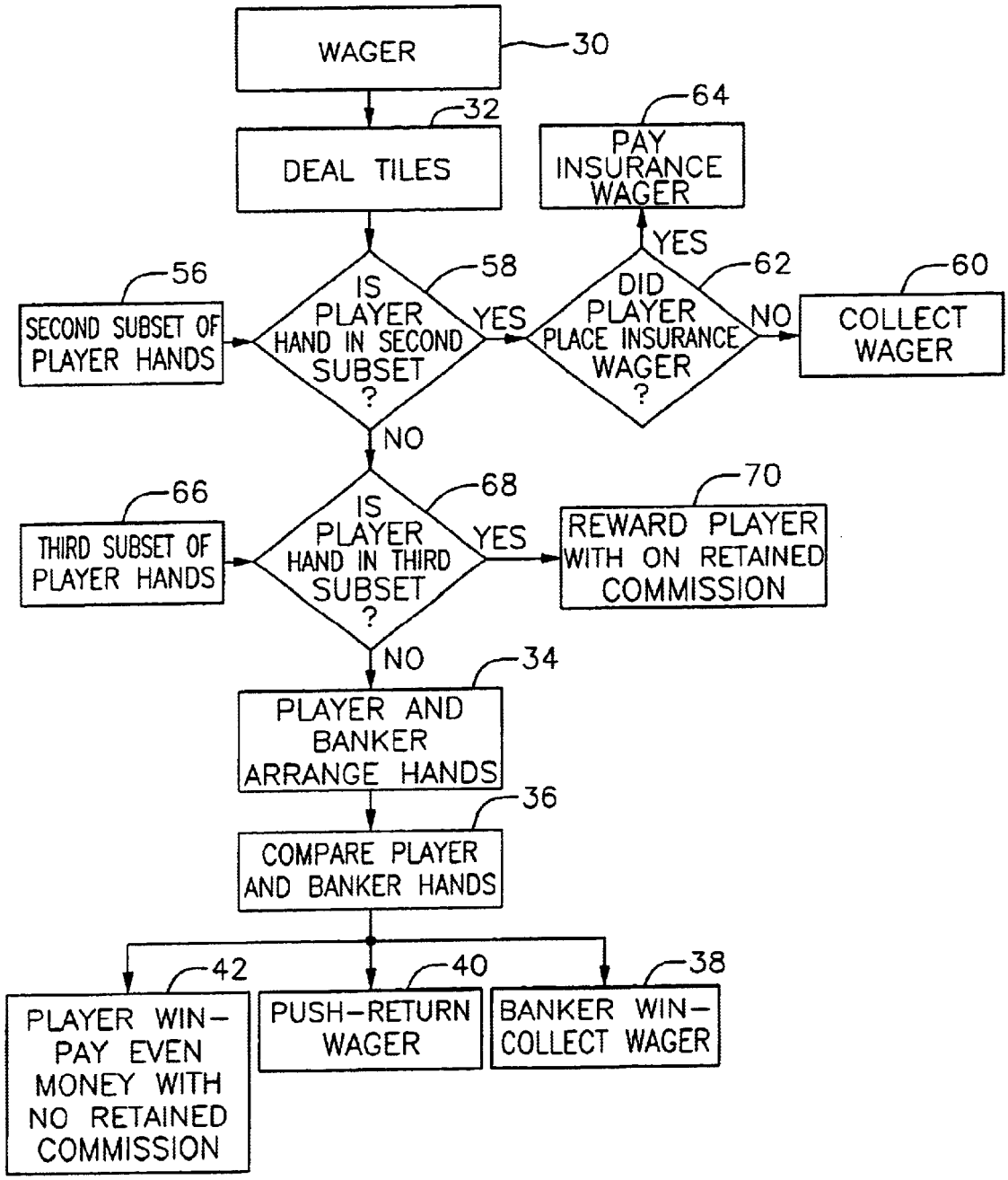
FIG. 4 is a flowchart of a Pai Gow game according to an alternate embodiment of the present invention.

Referring to FIGS. 3 and 4, players place a wager 30 by positioning one or more gaming checks in the player's betting area 20. Table minimums and maximums fixed by the game operator may dictate the minimum and maximum amount of such wagers 30 that can be made by the player.

In advance of dealing the hand, the dealer mixes or shuffles the Pai Gow tiles and arranges the thirty-two tiles in eight stacks of four tiles each. After players have wagered 30, the dealer distributes 32 the stacks of tiles to the players and the banker who, as discussed above, may be dealer in a house banked game or one of the players if the bank rotates. In traditional Pai Gow, the dealer shakes dice to determine which player receives the first stack of tiles and the remaining stacks are distributed in sequence. The player positions may be numbered to assist in distributing 32 the stacks of tiles. If fewer than seven players play, any undistributed hands are removed from play and set aside.

Each player arranges 34 his or her four-tile hand into a two-tile high hand and a two-tile low hand. The only restriction in arranging 34 the hands is that the high hand must not have a lower ranking than the low hand according to the rules of ranking of Pai Gow. Each player lays his or her high and low hands on the layout 10 with the low hand in front of the high hand.

The banker arranges 34 the banker's four-tile hand into a two-tile low hand and a two-tile high hand in the same manner described above. It is contemplated that game operators may have certain house rules regarding the arrangement of the banker's high and low hands.

The player's hands are serially compared 36 to the banker's hands to determine if the player has obtained a player winning, banker winning, or push outcome. A banker winning outcome 38 occurs if the player's high and low hands do not outrank the banker's high and low hands, respectively. Similarly, a player winning outcome 42 occurs if the player's high and low hands both outrank the banker's high and low hands, respectively. Finally, a push outcome 40 occurs if one player hand does not outrank the corresponding banker hand and the remaining player hand outranks the corresponding banker hand.

The improvement of the present invention departs from Pai Gow in the reward issued to players In Pai Gow of the prior art, a commission is retained by the game operator, through the dealer, on player winning outcomes. The present invention eliminates the retained commission by issuing a reward at a modified rate for certain outcomes or by collecting wagers on certain outcomes.

In one embodiment of the present invention, shown in FIG. 3, a first subset 44 comprising banker high and low hands is defined. In comparing 48 a player's hands to the banker's hands, if a player winning outcome occurs 50 and the banker's hands are within 46 the first subset 44, players are rewarded 50 at a modified rate greater than or equal to zero and less than even money. That is, if the banker's hands are within 46 the first subset 44, player winning outcomes 50 are paid at a modified rate less than even money, rather than at even money. Conversely, if a player obtains a player winning outcome 42 and the banker's hands are not within 46 the first subset 44, the player is rewarded at even money with no commission retained by the house. Other wagers are resolved as in Pai Gow with player's wagers being collected for banker winning outcomes 54 and the player's wager being neither collected nor rewarded for push outcomes 52.

It is contemplated that the first subset 44 may include any set of high and low hands. In one optional embodiment, the first subset 44 includes one or more banker low hands. A hand ranking chart, shown as Table 2, may be constructed to determine a mathematical ranking of possible hands. The hand ranking chart may be used to select a first subset 44 by, for example, selecting all banker low hands below a defined ranking.

TABLE 2

| Tile | 12 | 2 | H8 | H4 | H10 | H6 | L4 | 11 | L10 | H7 | L6 | 9 | L8 | L7 | 5 | Gee |
|---|---|---|---|---|---|---|---|---|---|---|---|---|---|---|---|---|
| 12 | 101 | 35 | 84 | 54 | 15 | 72 | 54 | 25 | 15 | 82 | 72 | 86 | 84 | 82 | 64 | 72 |
| 2 | 35 | 100 | 83 | 53 | 14 | 71 | 53 | 24 | 14 | 81 | 71 | 85 | 83 | 81 | 63 | 71 |
| H8 | 84 | 83 | 99 | 13 | 70 | 34 | 13 | 80 | 70 | 45 | 34 | 62 | 52 | 45 | 23 | 34 |
| H4 | 54 | 53 | 13 | 98 | 33 | 1 | 69 | 44 | 33 | 7 | 1 | 22 | 12 | 7 | 79 | 61 |
| H10 | 15 | 14 | 70 | 33 | 97 | 51 | 32 | 6 | 1 | 60 | 51 | 78 | 68 | 60 | 43 | 51 |
| H6 | 72 | 71 | 34 | 1 | 51 | 96 | 1 | 59 | 50 | 21 | 11 | 42 | 31 | 21 | 5 | 77 |
| L4 | 54 | 53 | 13 | 69 | 32 | 1 | 95 | 41 | 30 | 4 | 1 | 20 | 10 | 4 | 76 | 58 |
| 11 | 25 | 24 | 80 | 44 | 6 | 59 | 41 | 94 | 3 | 67 | 57 | 1 | 75 | 67 | 49 | 57 |
| L10 | 15 | 14 | 70 | 33 | 1 | 50 | 30 | 3 | 93 | 56 | 48 | 74 | 66 | 56 | 40 | 48 |
| H7 | 82 | 81 | 45 | 7 | 60 | 21 | 4 | 67 | 56 | 92 | 19 | 47 | 39 | 29 | 9 | 19 |
| L6 | 72 | 71 | 34 | 1 | 51 | 11 | 1 | 57 | 48 | 19 | 91 | 38 | 28 | 18 | 2 | 73 |
| 9 | 86 | 85 | 62 | 22 | 78 | 42 | 20 | 1 | 74 | 47 | 38 | 90 | 55 | 46 | 27 | 37 |
| L8 | 84 | 83 | 52 | 12 | 68 | 31 | 10 | 75 | 66 | 39 | 28 | 55 | 89 | 36 | 17 | 26 |
| L7 | 82 | 81 | 45 | 7 | 60 | 21 | 4 | 67 | 56 | 29 | 18 | 46 | 36 | 88 | 8 | 16 |

TABLE 2-continued

| Tile | 12 | 2 | H8 | H4 | H10 | H6 | L4 | 11 | L10 | H7 | L6 | 9 | L8 | L7 | 5 | Gee |
|---|---|---|---|---|---|---|---|---|---|---|---|---|---|---|---|---|
| 5 | 64 | 63 | 23 | 79 | 43 | 5 | 76 | 49 | 40 | 9 | 2 | 27 | 17 | 8 | 87 | 65 |
| Gee | 72 | 71 | 34 | 61 | 51 | 77 | 58 | 57 | 48 | 19 | 73 | 37 | 26 | 16 | 65 | 102 |

In Table 2, H8 represents High Eight, H4 represents High Four, H10 represents High Ten, H6 represents High Six, LA represents Low Four, L10 represents Low Ten, H7 represents High Seven, L6 represents Low Six, L8 represents Low Eight, L7 represents Low Seven, and Gee represents either of the Wild Three or Wild Six known in conventional Pai Gow tiles.

For example, in one optional embodiment, the first subset 44 includes any high hand combined with low hands with a ranking less than eight in Table 2. In such an embodiment, the player winning outcomes 50 are rewarded at a modified rate of zero, that is, the player's wager is returned but the player is not rewarded.

In an alternate optional embodiment, the first subset 44 includes any high hand combined with low hands with a ranking less than sixteen in Table 2. In such an embodiment, the player winning outcomes 50 are rewarded at a modified rate of 1:2, that is, the player's wager is rewarded at a reduced rate In another optional embodiment, shown in FIG. 4, the method may include defining a second subset 56 of player hands. The second subset 56 of player hands automatically results in a banker winning outcome when obtained by a player. That is, if the player's high and low hands are within 58 the second subset 56, the player loses 60 his or her wager without regard to the result of the comparison to the banker high and low hands. As above, all other player winning outcomes 42 are paid at even money with no commission retained by the house. All other banker winning outcomes 38 and 10 push outcomes 40 are resolved as in Pai Gow.

It is contemplated that the second set 56 could comprise any player high and low hands. For example, in an optional embodiment, the second subset 56 comprises any high hand combined with ?t low hand less than eight as shown in Table 2.

In this embodiment, an additional feature of an insurance wager 62 may be provided. The insurance wager 62 would pay 64, optionally at even money, if the player receives a hand in the second subset 56. However, the player would lose his insurance wager if any other hand is dealt.

In a further embodiment of the present method, a third subset 66 of player hands is defined. The third subset 66 of player hands automatically results in a player winning outcome 70 when obtained by a player. That is, if the player's high and low hands are within the third subset 66 the player is rewarded 70 at greater than or equal to even money without regard to the result of the comparison to the banker high and low hands.

In a further optional embodiment, the player could be rewarded 70 at greater than or equal to even money if the player's high and low hands are within 68 the third subset 66 and the player's high and low hands both outrank the banker's high and low hands, respectively. In other words, for example, an optional two tier reward could be established for players having high and low hands within the third subset 66—a first reward may be issued for merely having a high and low hand within 68 the third subset 66, another reward, optionally greater than the first reward, may be issued for having a high and low hand within 68 the third subset 66 and having player high and low hands outranking the banker high and low hands, respectively. It is contemplated that these rewards need not both be used. That is, the game operator could have the flexibility to operate a game utilizing the two tier reward system or selecting only one of the rewards. Once again, all other player winning outcomes 42 are paid at even money with no commission retained by the house and all banker winning outcomes 38 and push outcomes 40 are resolved as in Pai Gow.

Again, it is contemplated that the third subset 66 could include any set of player high and low hands. For example, in one optional embodiment, the third subset 66 comprises any high hand combined with a low hand greater than Gong. In such an embodiment, the player is rewarded at 3:2 regardless of the comparison to the banker hands.

The first 44, second 56, and third subsets 66 could be combined in various manners and the examples and embodiments described herein should be considered exemplary rather than restricting.

While certain embodiments of the present invention have been shown and described it is to be understood that the present invention is subject to many modifications and changes without departing from the spirit and scope of the claims presented herein

I claim:

1. An improved method of playing a Pai Gow tile game between at least one player and a banker, the Pai Gow game including players making a wager, the players and banker each receiving four tiles and arranging the tiles into a two-tile high hand and a two-tile low hand, the wagers being resolved by comparing the banker high hand and low hand to each player high hand and low hand, respectively, a banker winning outcome occurring if the player's high and low hands do not outrank the banker's high and low hands, respectively, a player winning outcome occurring if the player's high and low hands both outrank the banker's high and low hands, respectively, and a push outcome occurring if one player hand does not outrank the corresponding banker hand and the remaining player hand outranks the corresponding banker hand, the improvement comprising:

defining a first subset o banker high and low hands; and if, upon comparison of the player high and low hands to the banker high and low hands, respectively, a player winning outcome is obtained and the banker high and low hands are within the first subset of banker hands, the player being rewarded at a modified rate greater than or equal to zero and less than even money;

if the banker high and low hands are not within the first subset of banker hands, rewarding player winning outcomes at even money with no commission retained;

collecting wagers from players on banker winning outcomes; and neither collecting nor rewarding wagers on push outcomes.

2. The improved method of claim 1 wherein said first subset comprises any high hand combined with a low hand ranking lower than eight on the following hand ranking chart:

| Tile | 12 | 2 | H8 | H4 | H10 | H6 | L4 | 11 | L10 | H7 | L6 | 9 | L8 | L7 | 5 | Gee |
|---|---|---|---|---|---|---|---|---|---|---|---|---|---|---|---|---|
| 12 | 101 | 35 | 84 | 54 | 15 | 72 | 54 | 25 | 15 | 82 | 72 | 86 | 84 | 82 | 64 | 72 |
| 2 | 35 | 100 | 83 | 53 | 14 | 71 | 53 | 24 | 14 | 81 | 71 | 85 | 83 | 81 | 63 | 71 |
| H8 | 84 | 83 | 99 | 13 | 70 | 34 | 13 | 80 | 70 | 45 | 34 | 62 | 52 | 45 | 23 | 34 |
| H4 | 54 | 53 | 13 | 98 | 33 | 1 | 69 | 44 | 33 | 7 | 1 | 22 | 12 | 7 | 79 | 61 |
| H10 | 15 | 14 | 70 | 33 | 97 | 51 | 32 | 6 | 1 | 60 | 51 | 78 | 68 | 60 | 43 | 51 |
| H6 | 72 | 71 | 34 | 1 | 51 | 96 | 1 | 59 | 50 | 21 | 11 | 42 | 31 | 21 | 5 | 77 |
| L4 | 54 | 53 | 13 | 69 | 32 | 1 | 95 | 41 | 30 | 4 | 1 | 20 | 10 | 4 | 76 | 58 |
| 11 | 25 | 24 | 80 | 44 | 6 | 59 | 41 | 94 | 3 | 67 | 57 | 1 | 75 | 67 | 49 | 57 |
| L10 | 15 | 14 | 70 | 33 | 1 | 50 | 30 | 3 | 93 | 56 | 48 | 74 | 66 | 56 | 40 | 48 |
| H7 | 82 | 81 | 45 | 7 | 60 | 21 | 4 | 67 | 56 | 92 | 19 | 47 | 39 | 29 | 9 | 19 |
| L6 | 72 | 71 | 34 | 1 | 51 | 11 | 1 | 57 | 48 | 19 | 91 | 38 | 28 | 18 | 2 | 73 |
| 9 | 86 | 85 | 62 | 22 | 78 | 42 | 20 | 1 | 74 | 47 | 38 | 90 | 55 | 46 | 27 | 37 |
| L8 | 84 | 83 | 52 | 12 | 68 | 31 | 10 | 75 | 66 | 39 | 28 | 55 | 89 | 36 | 17 | 26 |
| L7 | 82 | 81 | 45 | 7 | 60 | 21 | 4 | 67 | 56 | 29 | 18 | 46 | 36 | 88 | 8 | 16 |
| 5 | 64 | 63 | 23 | 79 | 43 | 5 | 76 | 49 | 40 | 9 | 2 | 27 | 17 | 8 | 87 | 65 |
| Gee | 72 | 71 | 34 | 61 | 51 | 77 | 58 | 57 | 48 | 19 | 73 | 37 | 26 | 16 | 65 | 102 |

wherein H8 represents High Eight, H4 represents High Four, H10 represents High Ten, H6 represents High Six, L4 represents Low Four, L10 represents Low Ten, H7 represents High Seven, L6 represents Low Six, L8 represents Low Eight, L7 represents Low Seven, and Gee represents either of the Wild Three or Wild Six known in conventional Pai Gow tiles.

3. The improved method of claim 1 wherein said first subset comprises any high hand combined with a low hand lower than sixteen according to the following hand ranking char:

| Tile | 12 | 2 | H8 | H4 | H10 | H6 | L4 | 11 | L10 | H7 | L6 | 9 | L8 | L7 | 5 | Gee |
|---|---|---|---|---|---|---|---|---|---|---|---|---|---|---|---|---|
| 12 | 101 | 35 | 84 | 54 | 15 | 72 | 54 | 25 | 15 | 82 | 72 | 86 | 84 | 82 | 64 | 72 |
| 2 | 35 | 100 | 83 | 53 | 14 | 71 | 53 | 24 | 14 | 81 | 71 | 85 | 83 | 81 | 63 | 71 |
| H8 | 84 | 83 | 99 | 13 | 70 | 34 | 13 | 80 | 70 | 45 | 34 | 62 | 52 | 45 | 23 | 34 |
| H4 | 54 | 53 | 13 | 98 | 33 | 1 | 69 | 44 | 33 | 7 | 1 | 22 | 12 | 7 | 79 | 61 |
| H10 | 15 | 14 | 70 | 33 | 97 | 51 | 32 | 6 | 1 | 60 | 51 | 78 | 68 | 60 | 43 | 51 |
| H6 | 72 | 71 | 34 | 1 | 51 | 96 | 1 | 59 | 50 | 21 | 11 | 42 | 31 | 21 | 5 | 77 |
| L4 | 54 | 53 | 13 | 69 | 32 | 1 | 95 | 41 | 30 | 4 | 1 | 20 | 10 | 4 | 76 | 58 |
| 11 | 25 | 24 | 80 | 44 | 6 | 59 | 41 | 94 | 3 | 67 | 57 | 1 | 75 | 67 | 49 | 57 |
| L10 | 15 | 14 | 70 | 33 | 1 | 50 | 30 | 3 | 93 | 56 | 48 | 74 | 66 | 56 | 40 | 48 |
| H7 | 82 | 81 | 45 | 7 | 60 | 21 | 4 | 67 | 56 | 92 | 19 | 47 | 39 | 29 | 9 | 19 |
| L6 | 72 | 71 | 34 | 1 | 51 | 11 | 1 | 57 | 48 | 19 | 91 | 38 | 28 | 18 | 2 | 73 |
| 9 | 86 | 85 | 62 | 22 | 78 | 42 | 20 | 1 | 74 | 47 | 38 | 90 | 55 | 46 | 27 | 37 |
| L8 | 84 | 83 | 52 | 12 | 68 | 31 | 10 | 75 | 66 | 39 | 28 | 55 | 89 | 36 | 17 | 26 |
| L7 | 82 | 81 | 45 | 7 | 60 | 21 | 4 | 67 | 56 | 29 | 18 | 46 | 36 | 88 | 8 | 16 |
| 5 | 64 | 63 | 23 | 79 | 43 | 5 | 76 | 49 | 40 | 9 | 2 | 27 | 17 | 8 | 87 | 65 |
| Gee | 72 | 71 | 34 | 61 | 51 | 77 | 58 | 57 | 48 | 19 | 73 | 37 | 26 | 16 | 65 | 102 |

wherein H8 represents High Eight, H4 represents High Four, H10 represents High Ten, H6 represents High Six, L4 represents Low Four, L10 represents Low Ten, H7 represents High Seven, L6 presents Low Six, L8 represents Low Eight, L7 represents Low Seven, and Gee represents either of the Wild Three or Wild Six known in conventional Pai Gow tiles.

4. The improved method of claim 1 further comprising:

defining a second subset of player hands that automatically results in a banker winning outcome; and collecting the player's wager if the player's high and low hands are within the second subset without regard to the result of the comparison to the banker high and low hands.

5. The improved method of claim 4 wherein said second subset comprises any high hand combined with a low hand less than eight according to the following hand ranking chart:

| Tile | 12 | 2 | H8 | H4 | H10 | H6 | L4 | 11 | L10 | H7 | L6 | 9 | L8 | L7 | 5 | Gee |
|---|---|---|---|---|---|---|---|---|---|---|---|---|---|---|---|---|
| 12 | 101 | 35 | 84 | 54 | 15 | 72 | 54 | 25 | 15 | 82 | 72 | 86 | 84 | 82 | 64 | 72 |
| 2 | 35 | 100 | 83 | 53 | 14 | 71 | 53 | 24 | 14 | 81 | 71 | 85 | 83 | 81 | 63 | 71 |
| H8 | 84 | 83 | 99 | 13 | 70 | 34 | 13 | 80 | 70 | 45 | 34 | 62 | 52 | 45 | 23 | 34 |
| H4 | 54 | 53 | 13 | 98 | 33 | 1 | 69 | 44 | 33 | 7 | 1 | 22 | 12 | 7 | 79 | 61 |
| H10 | 15 | 14 | 70 | 33 | 97 | 51 | 32 | 6 | 1 | 60 | 51 | 78 | 68 | 60 | 43 | 51 |
| H6 | 72 | 71 | 34 | 1 | 51 | 96 | 1 | 59 | 50 | 21 | 11 | 42 | 31 | 21 | 5 | 77 |
| L4 | 54 | 53 | 13 | 69 | 32 | 1 | 95 | 41 | 30 | 4 | 1 | 20 | 10 | 4 | 76 | 58 |
| 11 | 25 | 24 | 80 | 44 | 6 | 59 | 41 | 94 | 3 | 67 | 57 | 1 | 75 | 67 | 49 | 57 |
| L10 | 15 | 14 | 70 | 33 | 1 | 50 | 30 | 3 | 93 | 56 | 48 | 74 | 66 | 56 | 40 | 48 |
| H7 | 82 | 81 | 45 | 7 | 60 | 21 | 4 | 67 | 56 | 92 | 19 | 47 | 39 | 29 | 9 | 19 |
| L6 | 72 | 71 | 34 | 1 | 51 | 11 | 1 | 57 | 48 | 19 | 91 | 38 | 28 | 18 | 2 | 73 |
| 9 | 86 | 85 | 62 | 22 | 78 | 42 | 20 | 1 | 74 | 47 | 38 | 90 | 55 | 46 | 27 | 37 |
| L8 | 84 | 83 | 52 | 12 | 68 | 31 | 10 | 75 | 66 | 39 | 28 | 55 | 89 | 36 | 17 | 26 |
| L7 | 82 | 81 | 45 | 7 | 60 | 21 | 4 | 67 | 56 | 29 | 18 | 46 | 36 | 88 | 8 | 16 |
| 5 | 64 | 63 | 23 | 79 | 43 | 5 | 76 | 49 | 40 | 9 | 2 | 27 | 17 | 8 | 87 | 65 |
| Gee | 72 | 71 | 34 | 61 | 51 | 77 | 58 | 57 | 48 | 19 | 73 | 37 | 26 | 16 | 65 | 102 |

wherein H8 represents High Eight, H4 represents High Four, H10 represents High Ten, H6 represents High Six, L4 represents Low Four, L10 represents Low Ten, H7 represents High Seven, L6 represents Low Six, L8 represents Low Eight, L7 represents Low Seven, and Gee represents either of the Wild Three or Wild Six known in conventional Pai Gow tiles.

6. The improved method of claim 4 further comprising:

players making an insurance wager; and for each player making an insurance wager, paying the player's insurance wager if the player's high and low hands are within the second subset or collecting the player's insurance wager if the player's high and low hands are not within the second subset.

7. The improved method of claim 1 further comprising:

defining a third subset of player hands that automatically results in a player winning outcome; and rewarding the player at greater than or equal to even money if the player's high and low hands are within the third subset without regard to the result of the comparison to the banker high and low hands.

8. The improved method of claim 7 wherein said third subset comprises any high hand combined with a low hand greater than Gong.

9. The improved method of claim 1 further comprising:

defining a third subset of player hands that automatically results in a player winning outcome; and rewarding the player at greater than or equal to even money if the player's high and low hands are within the third subset and outrank the banker's high and low hands, respectively.

10. The improved method of claim 1 further comprising:

defining a third subset of player hands that automatically results in a player winning outcome;

if the player's high and low hands are within the third subset, issuing either (a) a first reward of greater than or equal to even money without regard to the result of the comparison to the banker high and low hands or (b) a second reward of greater than or equal to even money if the player's high and low hands are within the third subset and outrank the banker's high and low hands, respectively, wherein said second reward is greater than said first reward.

11. An improved method of conducting a Pai Gow tile game by a casino for play between at least one player and a banker, the Pai Gow game including players making a wager, the players and banker each receiving four tiles and arranging the tiles into a two-tile high hand and a two-tile low hand, the banker resolving wagers by comparing the banker high hand and low hand to each player high hand and low hand, respectively, a banker winning outcome occurring if the player's high and low hands do not outrank the banker's high and low hands, respectively, a player winning outcome occurring if the player's high and low hands both outrank the banker's high and low hands, respectively, and a push outcome occurring if one player hand does not outrank the corresponding banker hand and the remaining player hand outranks the corresponding banker hand, the improvement comprising:

defining a first subset of banker hands, if, upon comparison of the player high and low hands to the banker high and low hands, respectively, a player winning outcome is obtained and the banker high and low hands are within the first subset of banker hands, the player being rewarded at a modified rate greater than or equal to zero and less than even money;

defining a second subset of player hands that automatically results in a banker winning outcome;

collecting the player's wager if the player's high and low hands are within the second subset without regard to the result of the comparison to the banker high and low hands;

defining a third subset of player hands that automatically results in a player winning outcome;

issuing a first reward of greater than or equal to even money if the player's high and low hands are within the third subset without regard to the result of the comparison to the banker high and low hands;

if the banker high and low hands are not within the first subset of banker hands, and the player's high and low hands are not within the second or third subsets of player hands, rewarding player winning outcomes at even money with no commission retained by the casino;

collecting wagers from players on banker winning outcomes; and neither collecting nor rewarding wagers on push outcomes.

12. The improved method of claim 11 further comprising issuing a second reward of greater than or equal to even money, rather than said first reward, if the player's high and low hands are within the third subset and outrank the banker's high and low hands, respectively, wherein said second reward is greater than said first reward.

13. The improved method of claim 11 wherein said first subset comprises any high hand combined with a low hand ranking lower than eight on the following hand ranking chart:

| Tile | 12 | 2 | H8 | H4 | H10 | H6 | L4 | 11 | L10 | H7 | L6 | 9 | L8 | L7 | 5 | Gee |
|---|---|---|---|---|---|---|---|---|---|---|---|---|---|---|---|---|
| 12 | 101 | 35 | 84 | 54 | 15 | 72 | 54 | 25 | 15 | 82 | 72 | 86 | 84 | 82 | 64 | 72 |
| 2 | 35 | 100 | 83 | 53 | 14 | 71 | 53 | 24 | 14 | 81 | 71 | 85 | 83 | 81 | 63 | 71 |
| H8 | 84 | 83 | 99 | 13 | 70 | 34 | 13 | 80 | 70 | 45 | 34 | 62 | 52 | 45 | 23 | 34 |
| H4 | 54 | 53 | 13 | 98 | 33 | 1 | 69 | 44 | 33 | 7 | 1 | 22 | 12 | 7 | 79 | 61 |
| H10 | 15 | 14 | 70 | 33 | 97 | 51 | 32 | 6 | 1 | 60 | 51 | 78 | 68 | 60 | 43 | 51 |
| H6 | 72 | 71 | 34 | 1 | 51 | 96 | 1 | 59 | 50 | 21 | 11 | 42 | 31 | 21 | 5 | 77 |
| L4 | 54 | 53 | 13 | 69 | 32 | 1 | 95 | 41 | 30 | 4 | 1 | 20 | 10 | 4 | 76 | 58 |
| 11 | 25 | 24 | 80 | 44 | 6 | 59 | 41 | 94 | 3 | 67 | 57 | 1 | 75 | 67 | 49 | 57 |
| L10 | 15 | 14 | 70 | 33 | 1 | 50 | 30 | 3 | 93 | 56 | 48 | 74 | 66 | 56 | 40 | 48 |
| H7 | 82 | 81 | 45 | 7 | 60 | 21 | 4 | 67 | 56 | 92 | 19 | 47 | 39 | 29 | 9 | 19 |
| L6 | 72 | 71 | 34 | 1 | 51 | 11 | 1 | 57 | 48 | 19 | 91 | 38 | 28 | 18 | 2 | 73 |
| 9 | 86 | 85 | 62 | 22 | 78 | 42 | 20 | 1 | 74 | 47 | 38 | 90 | 55 | 46 | 27 | 37 |
| L8 | 84 | 83 | 52 | 12 | 68 | 31 | 10 | 75 | 66 | 39 | 28 | 55 | 89 | 36 | 17 | 26 |
| L7 | 82 | 81 | 45 | 7 | 60 | 21 | 4 | 67 | 56 | 29 | 18 | 46 | 36 | 88 | 8 | 16 |
| 5 | 64 | 63 | 23 | 79 | 43 | 5 | 76 | 49 | 40 | 9 | 2 | 27 | 17 | 8 | 87 | 65 |
| Gee | 72 | 71 | 34 | 61 | 51 | 77 | 58 | 57 | 48 | 19 | 73 | 37 | 26 | 16 | 65 | 102 |

wherein H8 represents High Eight, H4 represents High Four, H10 represents High Ten, H6 represents High Six, L4 represents Low Four, L10 represents Low Ten, H7 represents High Seven, L6 represents Low Six, L8 represents Low Eight, L7 represents Low Seven, and Gee represents either of the Wild Three or Wild Six known in conventional Pai Gow tiles.

14. The improved method of claim 11 said first subset comprises any high hand combined with a low hand lower than sixteen according to the following hand ranking chart:

| Tile | 12 | 2 | H8 | H4 | H10 | H6 | L4 | 11 | L10 | H7 | L6 | 9 | L8 | L7 | 5 | Gee |
|---|---|---|---|---|---|---|---|---|---|---|---|---|---|---|---|---|
| 12 | 101 | 35 | 84 | 54 | 15 | 72 | 54 | 25 | 15 | 82 | 72 | 86 | 84 | 82 | 64 | 72 |
| 2 | 35 | 100 | 83 | 53 | 14 | 71 | 53 | 24 | 14 | 81 | 71 | 85 | 83 | 81 | 63 | 71 |
| H8 | 84 | 83 | 99 | 13 | 70 | 34 | 13 | 80 | 70 | 45 | 34 | 62 | 52 | 45 | 23 | 34 |
| H4 | 54 | 53 | 13 | 98 | 33 | 1 | 69 | 44 | 33 | 7 | 1 | 22 | 12 | 7 | 79 | 61 |
| H10 | 15 | 14 | 70 | 33 | 97 | 51 | 32 | 6 | 1 | 60 | 51 | 78 | 68 | 60 | 43 | 51 |
| H6 | 72 | 71 | 34 | 1 | 51 | 96 | 1 | 59 | 50 | 21 | 11 | 42 | 31 | 21 | 5 | 77 |
| L4 | 54 | 53 | 13 | 69 | 32 | 1 | 95 | 41 | 30 | 4 | 1 | 20 | 10 | 4 | 76 | 58 |
| 11 | 25 | 24 | 80 | 44 | 6 | 59 | 41 | 94 | 3 | 67 | 57 | 1 | 75 | 67 | 49 | 57 |
| L10 | 15 | 14 | 70 | 33 | 1 | 50 | 30 | 3 | 93 | 56 | 48 | 74 | 66 | 56 | 40 | 48 |
| H7 | 82 | 81 | 45 | 7 | 60 | 21 | 4 | 67 | 56 | 92 | 19 | 47 | 39 | 29 | 9 | 19 |
| L6 | 72 | 71 | 34 | 1 | 51 | 11 | 1 | 57 | 48 | 19 | 91 | 38 | 28 | 18 | 2 | 73 |
| 9 | 86 | 85 | 62 | 22 | 78 | 42 | 20 | 1 | 74 | 47 | 38 | 90 | 55 | 46 | 27 | 37 |
| L8 | 84 | 83 | 52 | 12 | 68 | 31 | 10 | 75 | 66 | 39 | 28 | 55 | 89 | 36 | 17 | 26 |
| L7 | 82 | 81 | 45 | 7 | 60 | 21 | 4 | 67 | 56 | 29 | 18 | 46 | 36 | 88 | 8 | 16 |
| 5 | 64 | 63 | 23 | 79 | 43 | 5 | 76 | 49 | 40 | 9 | 2 | 27 | 17 | 8 | 87 | 65 |
| Gee | 72 | 71 | 34 | 61 | 51 | 77 | 58 | 57 | 48 | 19 | 73 | 37 | 26 | 16 | 65 | 102 |

wherein H8 represents High Eight, H4 represents High Four, H10 represents High Ten, H6 represents High Six, L4 represents Low Four, L10 represents Low Ten, H7 represents High Seven, L6 represents Low Six, L8 represents Low Eight, L7 represents Low Seven, and Gee represents either of the Wild Three or Wild Six known in conventional Pai Cow tiles.

15. The improved method of claim 11 said second subset comprises any high hand combined with a low hand less than eight according to the following hand ranking chart:

| Tile | 12 | 2 | H8 | H4 | H10 | H6 | L4 | 11 | L10 | H7 | L6 | 9 | L8 | L7 | 5 | Gee |
|---|---|---|---|---|---|---|---|---|---|---|---|---|---|---|---|---|
| 12 | 101 | 35 | 84 | 54 | 15 | 72 | 54 | 25 | 15 | 82 | 72 | 86 | 84 | 82 | 64 | 72 |
| 2 | 35 | 100 | 83 | 53 | 14 | 71 | 53 | 24 | 14 | 81 | 71 | 85 | 83 | 81 | 63 | 71 |
| H8 | 84 | 83 | 99 | 13 | 70 | 34 | 13 | 80 | 70 | 45 | 34 | 62 | 52 | 45 | 23 | 34 |
| H4 | 54 | 53 | 13 | 98 | 33 | 1 | 69 | 44 | 33 | 7 | 1 | 22 | 12 | 7 | 79 | 61 |
| H10 | 15 | 14 | 70 | 33 | 97 | 51 | 32 | 6 | 1 | 60 | 51 | 78 | 68 | 60 | 43 | 51 |
| H6 | 72 | 71 | 34 | 1 | 51 | 96 | 1 | 59 | 50 | 21 | 11 | 42 | 31 | 21 | 5 | 77 |
| L4 | 54 | 53 | 13 | 69 | 32 | 1 | 95 | 41 | 30 | 4 | 1 | 20 | 10 | 4 | 76 | 58 |
| 11 | 25 | 24 | 80 | 44 | 6 | 59 | 41 | 94 | 3 | 67 | 57 | 1 | 75 | 67 | 49 | 57 |
| L10 | 15 | 14 | 70 | 33 | 1 | 50 | 30 | 3 | 93 | 56 | 48 | 74 | 66 | 56 | 40 | 48 |
| H7 | 82 | 81 | 45 | 7 | 60 | 21 | 4 | 67 | 56 | 92 | 19 | 47 | 39 | 29 | 9 | 19 |
| L6 | 72 | 71 | 34 | 1 | 51 | 11 | 1 | 57 | 48 | 19 | 91 | 38 | 28 | 18 | 2 | 73 |
| 9 | 86 | 85 | 62 | 22 | 78 | 42 | 20 | 1 | 74 | 47 | 38 | 90 | 55 | 46 | 27 | 37 |
| L8 | 84 | 83 | 52 | 12 | 68 | 31 | 10 | 75 | 66 | 39 | 28 | 55 | 89 | 36 | 17 | 26 |
| L7 | 82 | 81 | 45 | 7 | 60 | 21 | 4 | 67 | 56 | 29 | 18 | 46 | 36 | 88 | 8 | 16 |
| 5 | 64 | 63 | 23 | 79 | 43 | 5 | 76 | 49 | 40 | 9 | 2 | 27 | 17 | 8 | 87 | 65 |
| Gee | 72 | 71 | 34 | 61 | 51 | 77 | 58 | 57 | 48 | 19 | 73 | 37 | 26 | 16 | 65 | 102 |

wherein H8 represents High Eight, H4 represents High Four, H10 represents High Ten, H6 represents High Six, L4 represents Low Four, L10 represents Low Ten, H7 represents High Seven, L6 represents Low Six, L8 represents Low Eight, L7 represents Low Seven, and Gee represents either of the Wild Three or Wild Six known in conventional Pai Gow tiles.

16. The improved method of claim 11 wherein said third subset comprises any high hand combined with a low hand greater than Gong.

17. The improved method of claim 11 further comprising:

players making an insurance wager; and for each player making an insurance wager, paying the player's insurance wager if the player's high and low hands are within the second subset or collecting the player's insurance wager if the player's high and low hands are not within the second subset.

18. An improved method of playing a Pai Gow tile game between at least one player and a banker, the Pai Gow game including players making a wager, the players and banker each receiving four tiles and arranging the tiles into a two-tile high hand and a two-tile low hand, the banker resolving wagers by comparing the banker high hand and low hand to each player high hand and low hand, respectively, a banker winning outcome occurring if the player's high and low hands do not outrank the banker's high and low hands, respectively, a player winning outcome occurring if the player's high and low hands both outrank the banker's high and low hands, respectively, and a push outcome occurring if one player hand does not outrank the corresponding banker hand and the remaining player hand outranks the corresponding banker hand, the improvement comprising:

defining a first subset of at least one banker low hand;

if, upon comparison of the player high and low hands to the banker high and low hands, respectively, a player winning outcome is obtained and the banker low hand is within the first subset, the player being rewarded at a modified rate greater than or equal to zero and less than even money;

if the banker low hand is not within the first subset, rewarding player winning outcomes at even money with no commission retained;

collecting wagers from players on banker winning outcomes; and neither collecting nor rewarding wagers on push outcomes.

19. The improved method of claim 18 further comprising defining a second subset of at least one player low hand that automatically results in a banker winning outcome, and collecting the player's wager if the player's low hand is within the second subset without regard to the result of the comparison to the banker high and low hands.

20. The improved method of claim 18 further comprising:

defining a third subset of at least one player low hand that automatically results in a player winning outcome; and rewarding the player at greater than or equal to even money if the player's low hand is within the third subset without regard to the result of the comparison to the banker high and low hands.

21. The improved method of claim 20 further comprising issuing a second reward of greater than or equal to even money, rather than said first reward, if the player's high and low hands are within the third subset and outrank the banker's high and low hands, respectively, wherein said second reward is greater than said first reward.

22. An improved method of playing a Pai Gow tile game between at least one player and a banker, the Pai Gow game including players making a wager, the players and banker each receiving four tiles and arranging the tiles into a two-tile high hand and a two-tile low hand, the banker resolving wagers by comparing the banker high hand and low hand to each player high hand and low hand, respectively, a banker winning outcome occurring if the player's high and low hands do not outrank the banker's high and low hands, respectively, a player winning outcome occurring if the player's high and low hands both outrank the banker's high and low hands, respectively, and a push outcome occurring if one player hand does not outrank the corresponding banker hand and the remaining player hand outranks the corresponding banker hand, the improvement comprising:

defining a second subset of player hands that automatically results in a banker winning outcome, collecting the player's wager if the player's high and low hands are within the second subset without regard to the result of the comparison to the banker high and low hands;

rewarding player winning outcomes at even money with no commission retained collecting wagers from players on banker winning outcomes; and neither collecting nor rewarding wagers on push outcomes.

23. The improved method of claim 22 further comprising:

defining a first subset of at least one banker low hand; and if, upon comparison of the player high and low hands to the banker high and low hands, respectively, a player winning outcome is obtained and the banker low hand is within the first subset, the player being rewarded at a modified rate greater than or equal to zero and less than even money.

24. The improved method of claim 22 further comprising:

players making an insurance wager; and for each player making an insurance wager, paying the player's insurance wager if the player's high and low hands are within the second subset or collecting the player's insurance wager if the player's high and low hands are not within the second subset.

25. The improved method of claim 22 further comprising:

defining a third subset of at least one player low hand that automatically results in a player winning outcome; and rewarding the player at greater than or equal to even money if the player's low hand is within the third subset without regard to the result of the comparison to the banker high and low hands.

26. The improved method of claim 25 further comprising issuing a second reward of greater than or equal to even money, rather than said first reward, if the player's high and low hands are within the third subset and outrank the banker's high and low hands, respectively, wherein said second reward is greater than said first reward.

* * * * *